US008066482B2

(12) United States Patent
Strohl et al.

(10) Patent No.: US 8,066,482 B2
(45) Date of Patent: Nov. 29, 2011

(54) SHAPED COOLING HOLES FOR REDUCED STRESS

(75) Inventors: James Page Strohl, Stuart, FL (US); RuthAnn Rawlings, Stuart, FL (US); Robert Moore, Palm City, FL (US)

(73) Assignee: Alstom Technology Ltd. (CH)

( * ) Notice: Subject to any disclaimer, the term of this patent is extended or adjusted under 35 U.S.C. 154(b) by 490 days.

(21) Appl. No.: 12/277,704

(22) Filed: Nov. 25, 2008

(65) Prior Publication Data

US 2010/0129213 A1 May 27, 2010

(51) Int. Cl.
*F04D 29/58* (2006.01)
*B63H 1/14* (2006.01)
*F01D 5/08* (2006.01)

(52) U.S. Cl. ..... 416/95; 415/115; 415/116; 416/1; 416/93 R

(58) Field of Classification Search ..... 415/115, 415/116; 416/1, 93 R, 95
See application file for complete search history.

(56) References Cited

U.S. PATENT DOCUMENTS

| | | | | | |
|---|---|---|---|---|---|
| 4,653,983 | A * | 3/1987 | Vehr | ..... | 416/97 R |
| 4,705,455 | A * | 11/1987 | Sahm et al. | ..... | 416/97 R |
| 4,923,371 | A * | 5/1990 | Ben-Amoz | ..... | 416/97 R |
| 6,287,075 | B1 * | 9/2001 | Kercher | ..... | 416/97 R |
| 6,435,815 | B2 * | 8/2002 | Harvey et al. | ..... | 415/115 |
| 7,887,294 | B1 * | 2/2011 | Liang | ..... | 416/97 R |
| 2009/0173834 | A1 * | 7/2009 | Prince et al. | ..... | 244/198 |

* cited by examiner

*Primary Examiner* — Asok Sarkar
(74) *Attorney, Agent, or Firm* — Shook, Hardy & Bacon L.L.P.

(57) ABSTRACT

A gas turbine engine component having shaped cooling holes that further enhances the cooling of a desired region while reducing stress levels in and around the cooling holes is disclosed. The cooling holes are generally elliptically-shaped and diffuse from a cooling fluid supply side to a discharge side and are oriented on the turbine component to reduce stress concentrations while directing the cooling fluid to a desired surface or location. The elliptical cooling holes have openings in the surface that have high points that are concentric and planar.

19 Claims, 7 Drawing Sheets

SHAPED COOLING HOLES FOR REDUCED STRESS

TECHNICAL FIELD

The present invention generally relates to a cooling hole configuration for a gas turbine component. More specifically, a tapered and elliptically-shaped cooling hole provides improved cooling flow and lower stresses in the turbine component.

BACKGROUND OF THE INVENTION

Gas turbine engines operate to produce mechanical work or thrust. Specifically, land-based gas turbine engines typically have a generator coupled thereto for the purposes of generating electricity. A gas turbine engine comprises an inlet that directs air to a compressor section, which has stages of rotating compressor blades. As the air passes through the compressor, the air pressure increases. The compressed air is then directed into one or more combustors where fuel is injected into the compressed air and the mixture is ignited. The hot combustion gases are then directed from the combustion section to a turbine section by a transition duct. The hot combustion gases cause the stages of the turbine to rotate, which in turn, causes the compressor to rotate.

The air and hot combustion gases are directed through a turbine section by turbine blades and vanes. These blades and vanes are subject to extremely high operating temperatures, often times upwards of 2500 deg. F. These temperatures often exceed the material capability from which the blades and vanes are made. In order to lower the effective operating temperature, the blades and vanes are cooled, often with air or steam. However, cooling hole geometry can also lead to areas of high stress. One such area of high stress is in a platform region of a turbine blade and vane. In prior art turbine blade/vane designs, the air passes through the platform by a series of round cooling holes. However, the blade/vane undergoes large variations in thermal gradients resulting in large thermal stresses. These stresses are actually compounded by the presence of the cooling holes, while providing cooling air to the region, have been found to be sources of stress risers. As a result, cracking has been known to occur in and around the cooling holes.

SUMMARY

In accordance with the present invention, there is provided a novel configuration of a shaped cooling hole that further enhances the cooling of a turbine blade or vane while reducing stress levels in and around the cooling holes. The cooling holes diffuse from a cooling fluid supply side to a cooling fluid discharge side and are shaped to reduce stress concentrations.

In an embodiment of the present invention, a component for a gas turbine comprises a first surface separated from a second surface by a thickness of material, and a plurality of cooling holes extend between the first surface and the second surface. The plurality of cooling holes have a generally elliptical shape at both the first surface and the second surface, with the hole tapering between the two surfaces so as to diffuse a cooling flow.

In an alternate embodiment, a tapered elliptical cooling hole is disclosed for a gas turbine engine having a first elliptically-shaped opening in a first surface and a second elliptically-shaped opening in a second surface. The second elliptically-shaped opening is larger than the first elliptically-shaped opening, with the first and second openings each having a first and second major and minor axes. A first point at the high point of the first major axis and a second point at the high point of the second major axis are concentric with each other and located within the same plane.

In yet another embodiment, a method of enhancing cooling flow to a turbine component while reducing operating stresses is disclosed. The method comprises providing a turbine component having a first surface spaced a distance apart from a second surface by a thickness. A plurality of generally elliptically-shaped cooling holes extend from the first surface to the second surface are placed in the thickness, with the cooling holes being tapered so as to diffuse while maintaining the elliptical cross section. A supply of cooling fluid is directed from the first surface, through the hole, and exiting the hole at the second surface. Depending on the orientation of the cooling hole, the cooling fluid can be directed onto the second surface or towards an adjacent turbine component.

Additional advantages and features of the present invention will be set forth in part in a description which follows, and in part will become apparent to those skilled in the art upon examination of the following, or may be learned from practice of the invention. The instant invention will now be described with particular reference to the accompanying drawings.

BRIEF DESCRIPTION OF THE SEVERAL VIEWS OF THE DRAWINGS

The present invention is described in detail below with reference to the attached drawing figures, wherein.

DETAILED DESCRIPTION

The subject matter of the present invention is described with specificity herein to meet statutory requirements. However, the description itself is not intended to limit the scope of this patent. Rather, the inventors have contemplated that the claimed subject matter might also be embodied in other ways, to include different components, combinations of components, steps, or combinations of steps similar to the ones described in this document, in conjunction with other present or future technologies.

Figure 1:
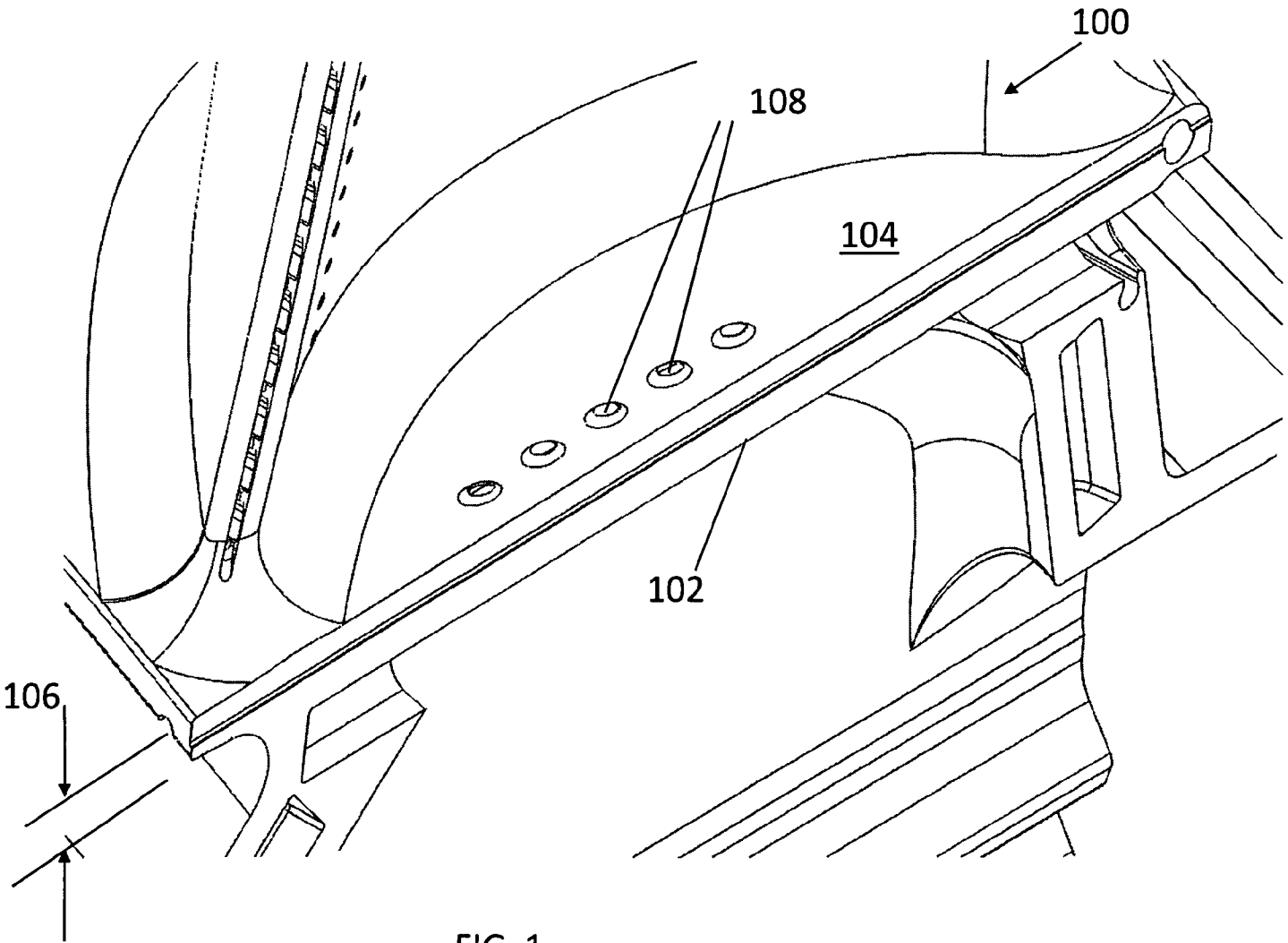
FIG. 1 is a perspective view of a gas turbine component having a cooling configuration in accordance with an embodiment of the present invention.
Figure 2:
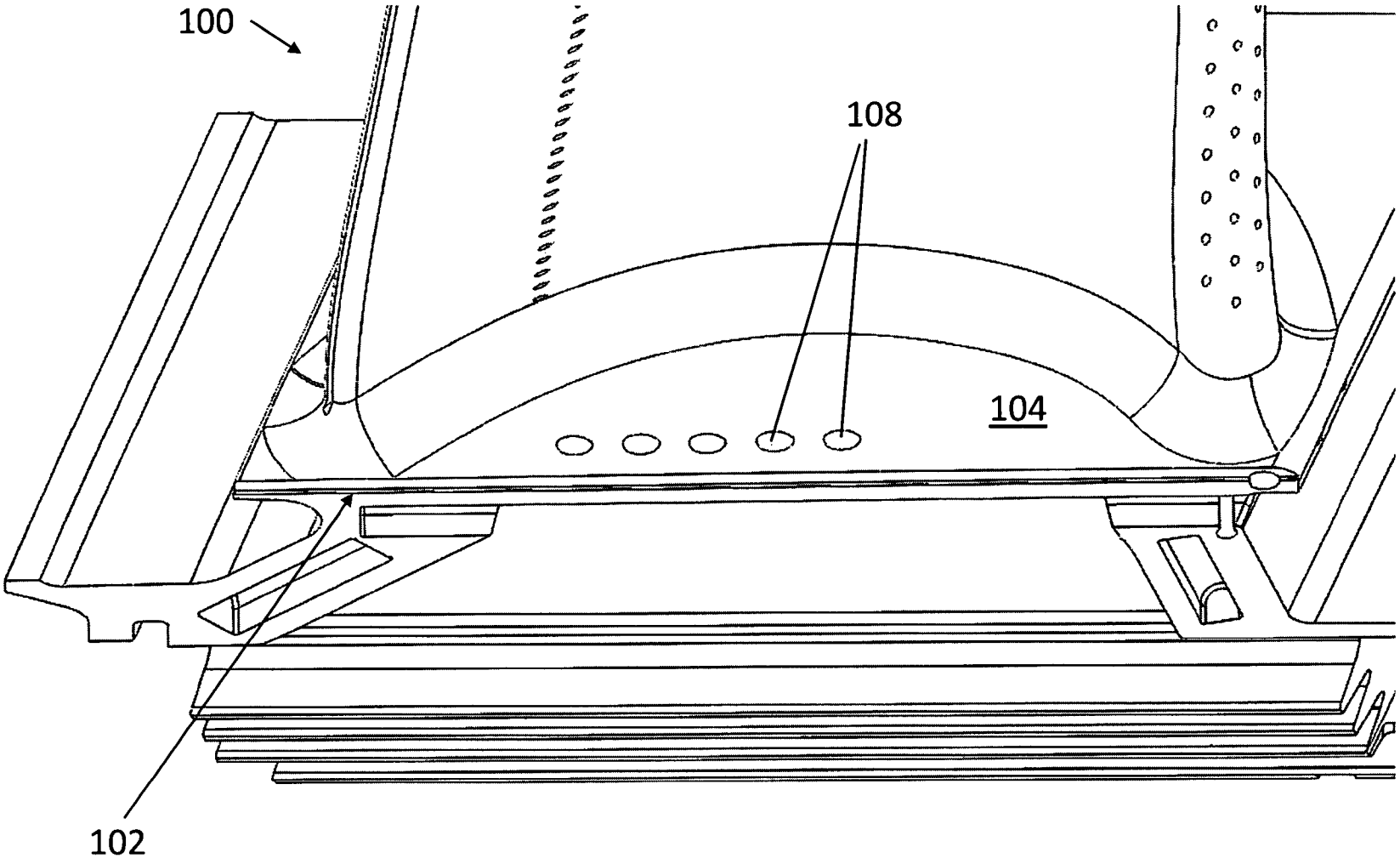
FIG. 2 is an alternate perspective view of a gas turbine component having a cooling configuration in accordance with an embodiment of the present invention.

An embodiment of the present invention is shown in conjunction with a gas turbine component 100, such as a turbine vane blade, in FIGS. 1 and 2. The component 100 has a first surface 102 and a second surface 104 that is separated from the first surface by a thickness 106 of material. Located in the component 100 is a plurality of cooling holes 108. The plurality of cooling holes 108 have a generally elliptical shape that tapers in cross section from the first surface 102 to the second surface 104. This tapering allows for a cooling fluid passing therethrough to be diffused.

Figure 3:
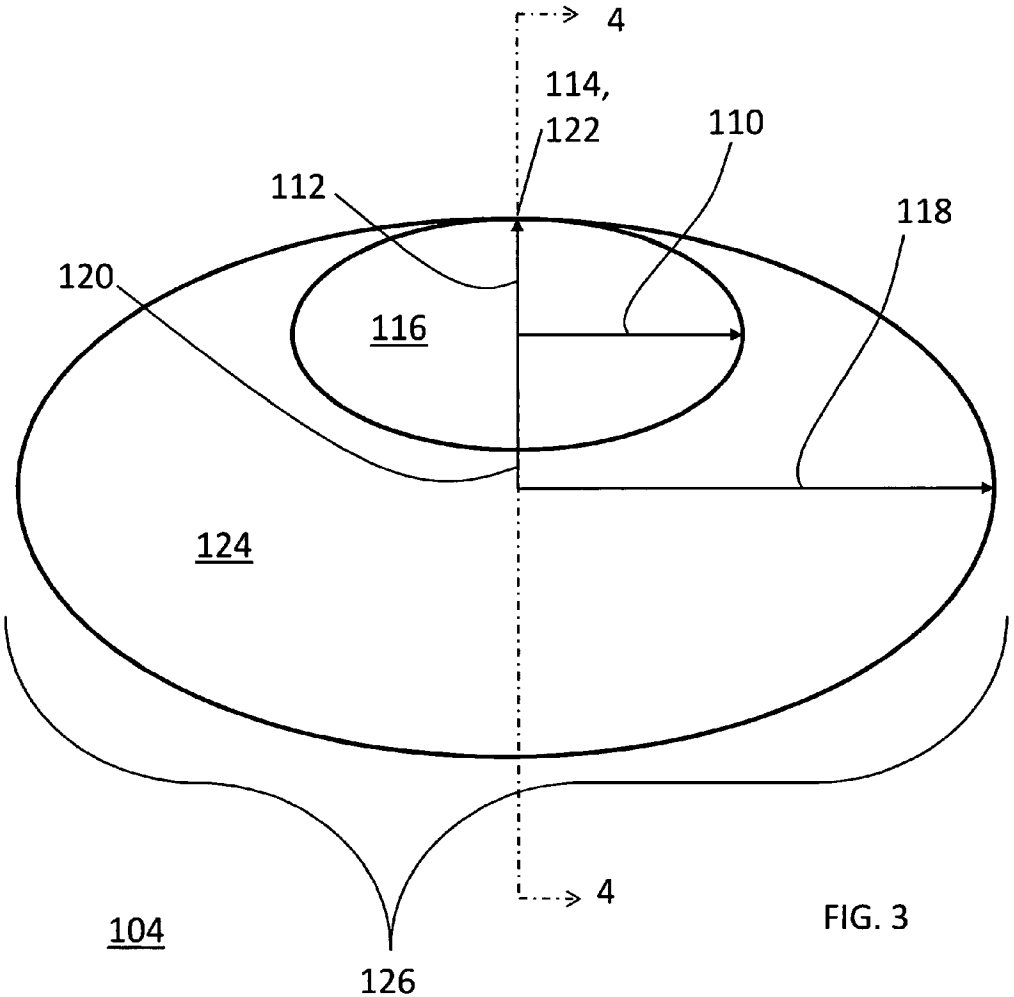
FIG. 3 is an end view looking through a cooling hole from the second surface of a gas turbine component in accordance with an embodiment of the present invention.
Figure 4:
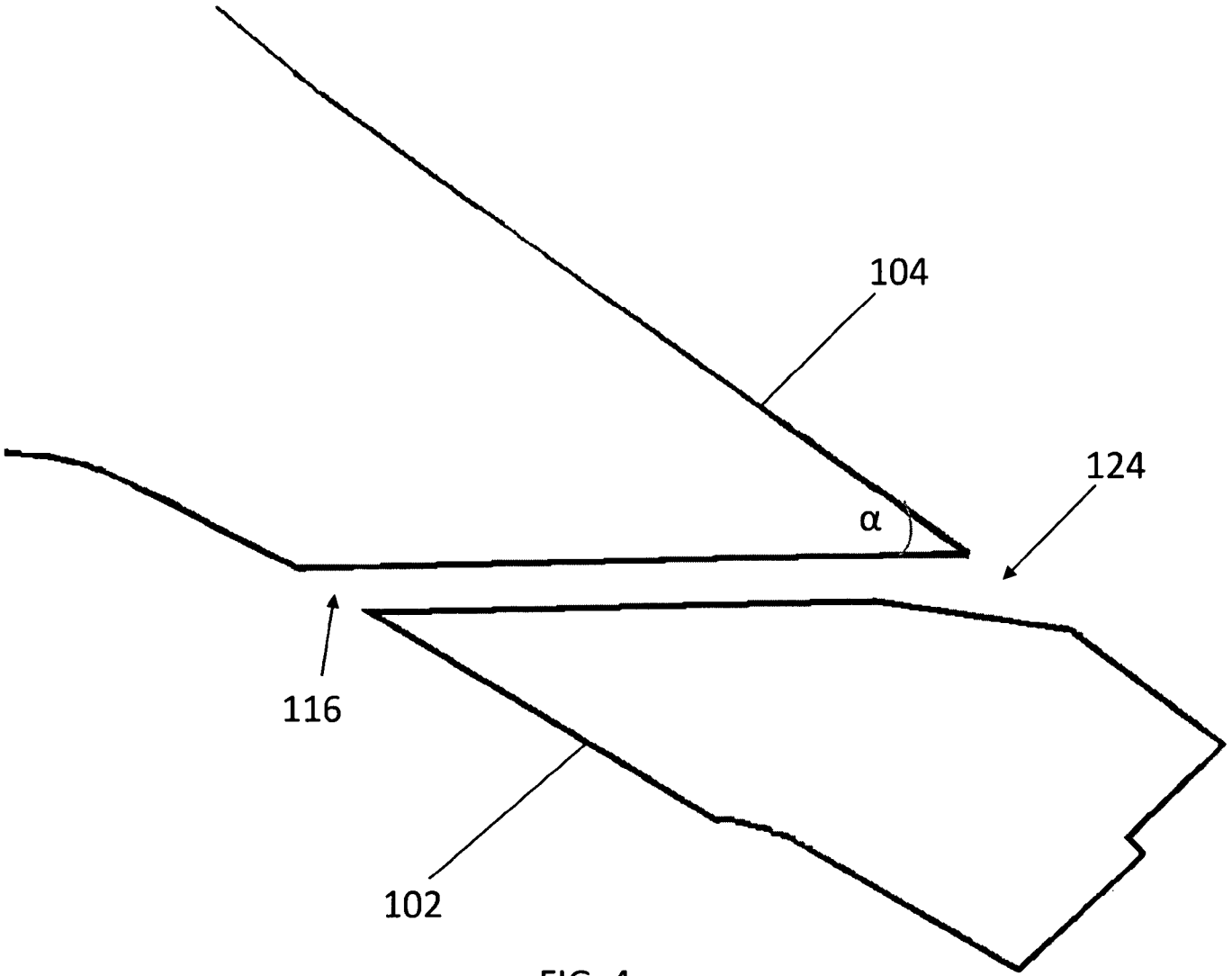
FIG. 4 is cross section view taken through a cooling hole of FIG. 3 in accordance with an embodiment of the present invention.
Figure 5:
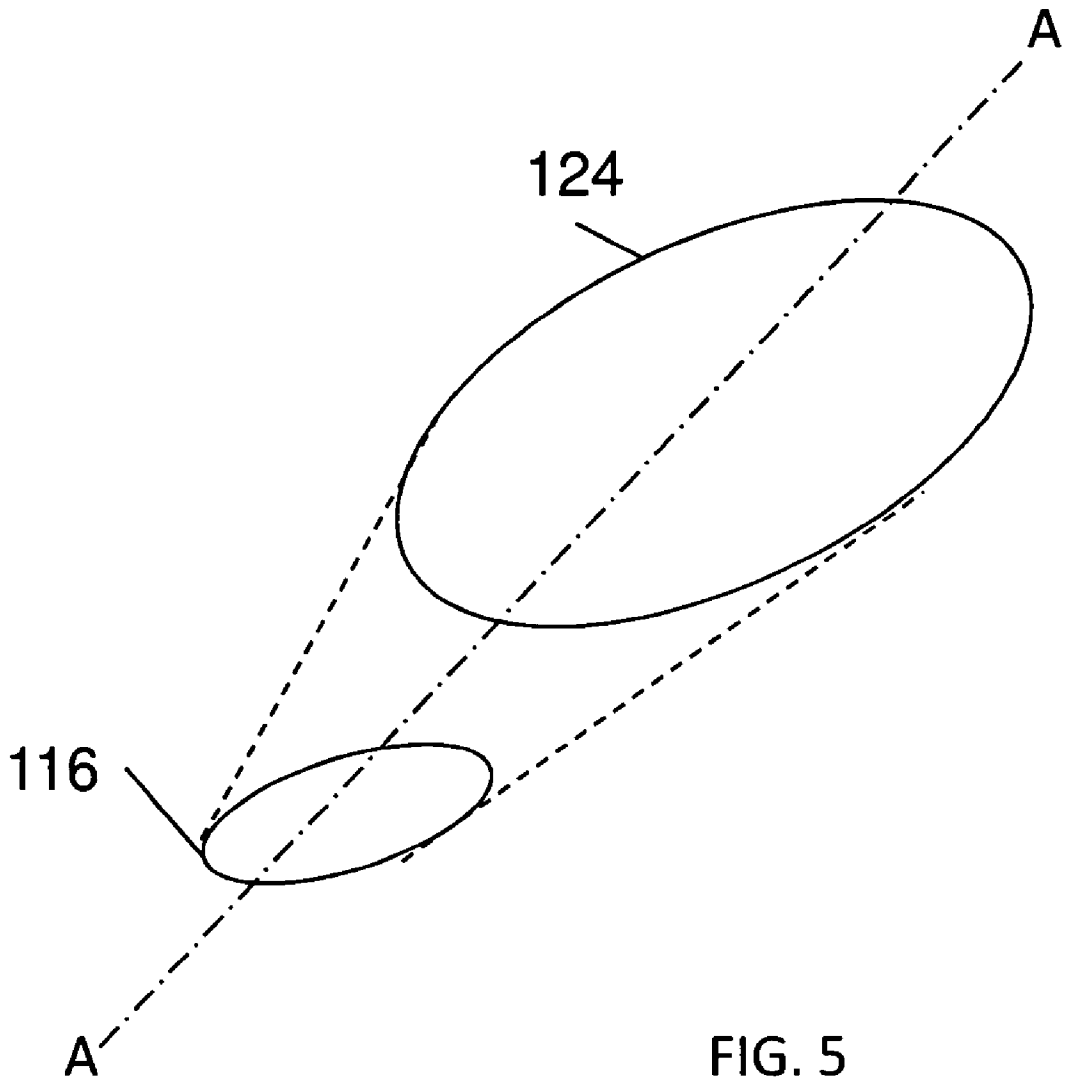
FIG. 5 is a perspective view of a cooling hole in accordance with an embodiment of the present invention.

Referring now to FIGS. 3-5, further attributes of the hole configuration can be seen. Specifically, FIG. 3 depicts a view of the hole looking down its central axis A-A (see FIG. 5). As it can be seen from FIG. 3, the cooling hole comprises a generally elliptical cross section at both the first surface 102 and the second surface 104. A cross section view through the hole showing the tapering as well as surface angle of the cooling hole 108 is shown in FIG. 4. Also shown in FIG. 4, the tapering of the elliptically-shaped hole can be only partially through the thickness 106 or can be a constant taper through the thickness 106. Referring to FIG. 5, the elliptically-shaped cooling hole 108 has a first major axis 110 and a first minor axis 112, with the ellipse having a first point 114. The first major axis 110 and first minor axis 112 are located in a first elliptical opening 116 in the first surface 102. The elliptically-shaped cooling hole 108 also has a second major axis 118 and a second minor axis 120 with the ellipse having a second point 122, where the first point 114 and the second point 122 are located in the same plane. The second major axis 118 and second minor axis 120 are located in a second elliptical opening 124 in the second surface 104.

In an embodiment of the present invention, the first major axis 110 is smaller than the second major axis 118 and the first minor axis 112 is less than the second minor axis 120, creating a tapering of the elliptically-shaped hole 108 from the first surface 102 to the second surface 104. Further, the first point 114 can be concentric with the second point 122 as depicted in FIG. 3.

Referring back to FIG. 4, the elliptically-shaped cooling hole 108 is preferably oriented at an acute angle $\alpha$ relative to the second surface 104. Orienting the cooling holes at such an angle can improve the projection of any cooling fluid passing through the holes. The plurality of cooling holes 108 can be oriented within a turbine component in a variety of manners. The cooling holes 108 can also be oriented such that a cooling fluid passing therethrough can be projected onto a desired surface such as a blade or vane platform or towards an adjacent component.

Figure 6:
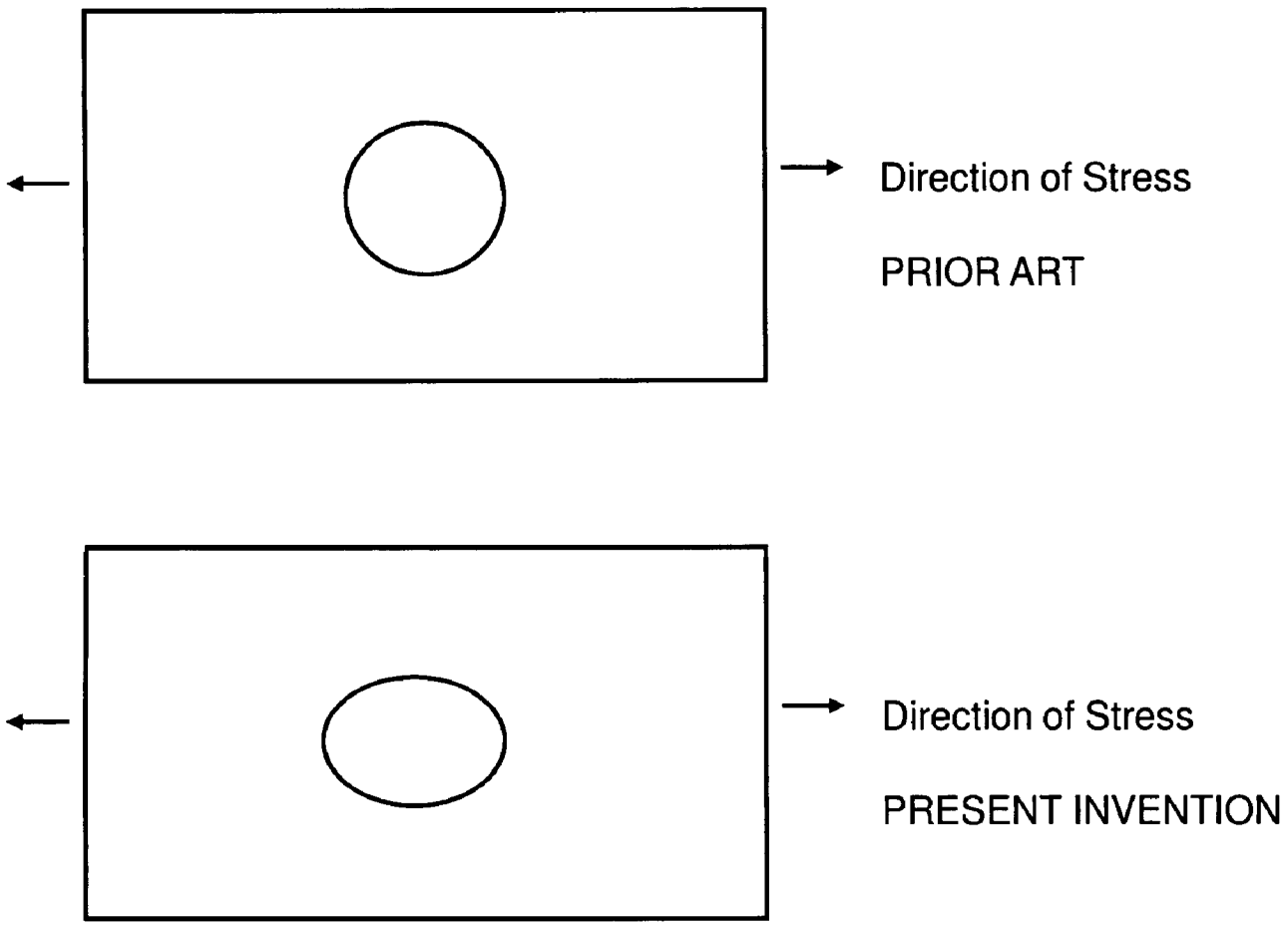
FIG. 6 depicts a comparison of cooling hole orientation relative to a stress field for the prior art and an embodiment of the present invention; and, FIG. 7 depicts a comparison of cooling coverage provided by cooling holes of the prior art and an embodiment of the present invention.

Referring to FIGS. 3 and 5, the elliptical shape of the cooling holes 108 has a first radius of curvature 126. The radius of curvature is generally formed by a surface created from the major axes. One such way in which the cooling holes 108 can be oriented is in a direction so as to deflect any stresses around the radius of curvature 126. Specifically referring to FIG. 6, an orientation of the cooling hole relative to a stress field is shown. By orienting the cooling holes 108 such that the major axes 110 and 118 are oriented generally parallel to the stress field, the radius of curvature spreads the stress field and eliminates prior stress concentrations.

Figure 7:
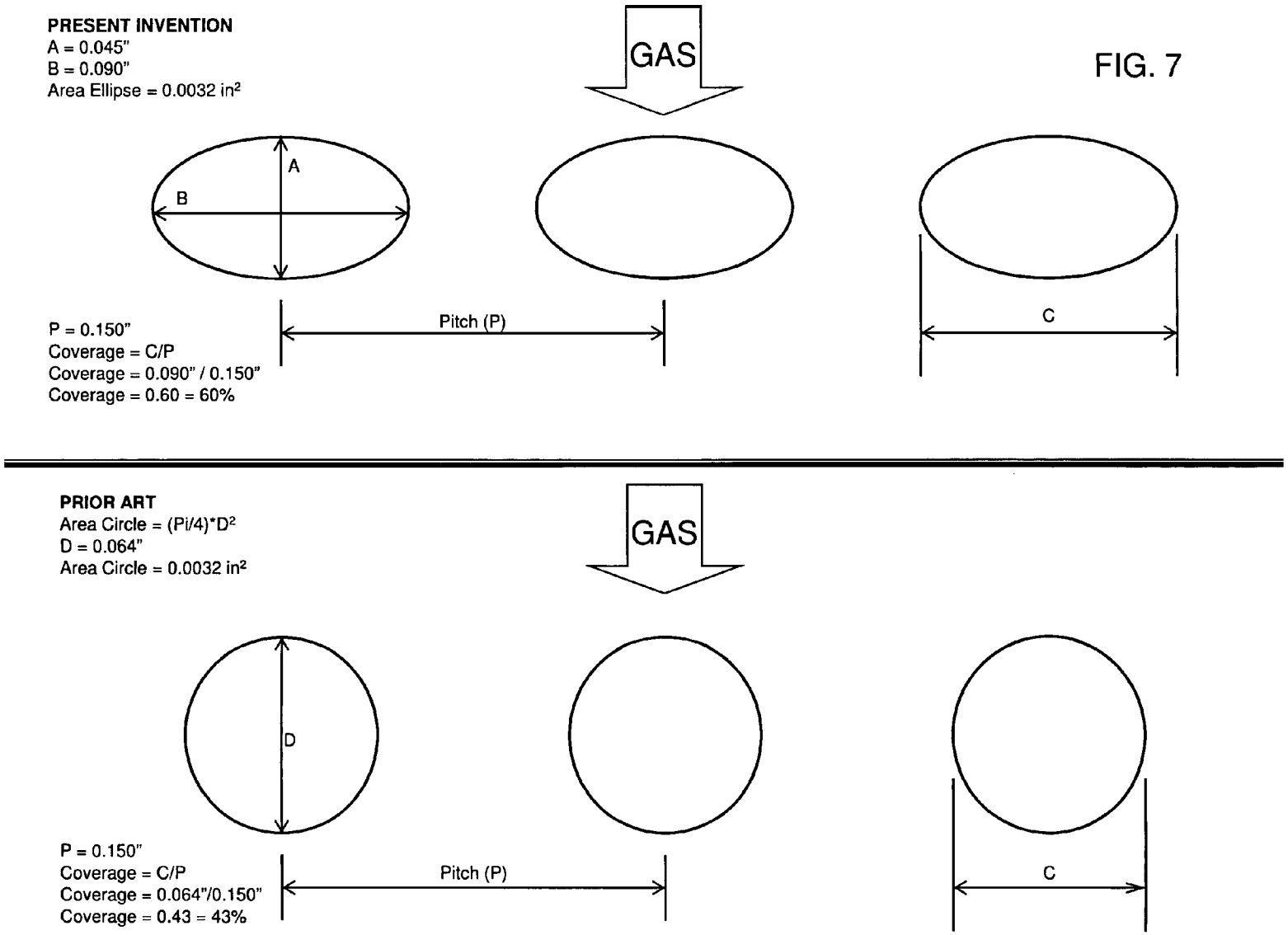

Further benefits of the present invention can be seen in FIG. 7, which depicts the improved coverage of the cooling fluid that is achieved with the present invention. For a given surface area, such as 0.0032 $in^2$, effective coverage of the cooling fluid passing through the hole is defined as effectively as the width C of the hole divided by a pitch P (spacing between holes). For the same surface area, an elliptically-shaped cooling hole of the present invention achieves 60% coverage, whereas a round hole of the prior art achieves 43% coverage. So, not only are stress concentrations reduced by the hole orientation, but cooling effectiveness is increased.

In an alternate embodiment of the present invention, a method of enhancing cooling flow onto a turbine component while reducing operating stresses is disclosed. The method comprises providing a turbine component having the first and second surfaces spaced apart by a thickness, as previously discussed. The turbine component has a supply of cooling fluid typically within the interior of the component. A plurality of generally-elliptically shaped cooling holes extending from the first surface to the second surface are placed in the turbine component. The cooling holes can taper in size while maintaining the generally elliptical shape so as to have a diffusing capability. The cooling fluid is directed through the plurality of cooling holes, passing from the first surface, through the holes and exiting the holes at the second surface. Depending on the surface angle of the cooling holes, the cooling fluid can be directed along the second surface or directed towards an adjacent turbine component. In an embodiment of the present invention, the cooling holes are located in a platform of a turbine vane, with the second surface being the surface of the platform exposed to hot combustion gases. The cooling holes can be angled to direct cooling fluid, such as air, onto this hot surface or oriented to project the cooling fluid towards an adjacent vane platform that is uncooled.

The elliptically-shaped cooling holes can be placed in the component by a variety of processes. Depending on the size, shape, and orientation of the cooling holes, the cooling holes can be laser drilled or machined into place using an electro-discharge machine with shaped electrodes having the desired hole size and taper. The holes can be machined individually or in groups. To minimize the stress concentrations at the corner of a hole, the acute edge of the hole is broken/rounded-off.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and within the scope of the claims.

What is claimed is:

1. A cooled gas turbine engine component comprising:

a first surface;

a second surface separated from the first surface by a thickness of material; and, a plurality of cooling holes extending between the first and second surfaces, the plurality of cooling holes having a generally elliptical shape that tapers in cross section through the full thickness of the material between the first surface to the second surface so as to diffuse a cooling flow.

2. The component of claim 1, wherein the cross section of the elliptical shape at the first surface has a first major axis, a first minor axis, and a first high point.

3. The component of claim 2, wherein the cross section of the elliptical shape at the second surface has a second major axis, a second minor axis, and a second high point.

4. The component of claim 3, wherein the first major axis is less than the second major axis and the first minor axis is less than the second minor axis.

5. The component of claim 4, wherein the first point and second point are concentric.

6. The component of claim 5, wherein the plurality of cooling holes are oriented at an acute surface angle relative to the second surface.

7. The component of claim 3, wherein a first radius of curvature is formed generally by a surface associated with the first major axis.

8. The component of claim 4, wherein the first radius of curvature is oriented in a direction to spread stresses around the cooling holes.

9. A tapered elliptical cooling hole comprising:

a first elliptically-shaped opening in a first surface and having a first major axis, a first minor axis, and a first point at a high point of the first major axis; and, a second elliptically-shaped opening in a second surface having a second major axis, a second minor axis, and a second point at a high point of the second major axis, the second surface spaced a distance from the first surface;

wherein the first point and the second point are concentric and located within a plane, and wherein the cooling hole tapers over the entire distance between the first elliptically-shaped opening in the first surface and the second elliptically-shaped opening in the second surface.

10. The tapered elliptical cooling hole of claim 9, wherein the elliptical cooling hole is located in a turbine blade or vane.

11. The tapered elliptical cooling hole of claim 9, wherein the second major axis is greater than the first major axis.

12. The tapered elliptical cooling hole of claim 11, wherein the second minor axis is greater than the first minor axis.

13. The tapered elliptical cooling hole of claim 9, wherein the cooling hole is oriented at an acute angle relative to a first surface.

14. The tapered elliptical cooling hole of claim 9, wherein the cooling hole maintains an elliptical cross section from the first surface to the second surface.

15. A method of enhancing cooling air flow onto a turbine component while reducing operating stresses comprising:

providing the turbine component having a first surface spaced a distance apart from a second surface by a thickness, the turbine component having a supply of cooling fluid;

placing a plurality of generally elliptically-shaped cooling holes extending from the first surface to the second surface, the cooling holes tapering through the entire distance between the first and second surface so as to diffuse the cooling holes from the first surface to the second surface; and, directing the cooling fluid through the plurality of generally elliptically-shaped cooling holes, the cooling fluid passing from the first surface, through the hole, and exiting the hole through the second surface.

16. The method of claim 15 further comprising directing the cooling fluid onto a turbine component adjacent to the turbine component having the plurality of cooling holes.

17. The method of claim 15 further comprising directing the cooling fluid along the second surface of the turbine component.

18. The method of claim 15, wherein the plurality of cooling holes have a first opening at the first surface and a second opening at the second surface and wherein an edge of the cooling holes at the first surface and second surface are concentric.

19. The method of claim 18, wherein the plurality of cooling holes are oriented at an acute surface angle relative to the second surface.

* * * * *